US011689859B2

(12) United States Patent
Kawase et al.

(10) Patent No.: US 11,689,859 B2
(45) Date of Patent: Jun. 27, 2023

(54) SOUND PROCESSING METHOD, AND SOUND PROCESSING SYSTEM

(71) Applicant: YAMAHA CORPORATION, Hamamatsu (JP)

(72) Inventors: Yoshinori Kawase, Hamamatsu (JP); Masaya Kano, Hamamatsu (JP); Tatsutoshi Abe, Hamamatsu (JP); Kotaro Terada, Hamamatsu (JP); Shunichi Kamiya, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/682,144

(22) Filed: Feb. 28, 2022

(65) Prior Publication Data

US 2022/0279278 A1 Sep. 1, 2022

(30) Foreign Application Priority Data

Mar. 1, 2021 (JP) ..... 2021-031526

(51) Int. Cl.
*H04R 5/04* (2006.01)
*H04R 29/00* (2006.01)

(52) U.S. Cl.
CPC ..... *H04R 5/04* (2013.01); *H04R 29/001* (2013.01)

(58) Field of Classification Search
None
See application file for complete search history.

(56) References Cited

U.S. PATENT DOCUMENTS 8,837,752 B2 * 9/2014 Fujita ..... H04H 60/04 381/119
8,938,078 B2 * 1/2015 Meyer ..... H04R 27/00 381/74

FOREIGN PATENT DOCUMENTS

JP H1185148 A 3/1999

* cited by examiner

*Primary Examiner* — Paul W Huber
(74) *Attorney, Agent, or Firm* — Rossi, Kimms & McDowell LLP

(57) ABSTRACT

Sound device receives a first sound signal from a first sound processor, generates a second sound signal based on the first sound signal, and transmits the second sound signal to a second sound processor. The second sound processor performs signal processing to the second sound signal to generate a third sound signal. The sound device receives the third sound signal from the second sound processor, checks a state of the second sound processor based on a signal received from the second sound processor, transmits a fourth sound signal based on the third sound signal to the first sound processor when determining that the state of the second sound processor is normal, and generates a fifth sound signal based on the first sound signal or the second sound signal to transmit it to the first sound processor when determining that the state of the second sound processor is abnormal.

20 Claims, 9 Drawing Sheets

SOUND PROCESSING METHOD, AND SOUND PROCESSING SYSTEM

CROSS REFERENCE TO RELATED APPLICATIONS

This Nonprovisional application claims priority under 35 U.S.C. § 119(a) on Patent Application No. 2021-031526 filed in Japan on Mar. 1, 2021, the entire contents of which are hereby incorporated by reference.

BACKGROUND

1. Technical Field

One exemplary embodiment of the invention relates to a sound processing method, and a sound processing system.

2. Background Information

Unexamined Japanese Patent Publication No. H11-085148 discloses an effector trial-use service system in which a user enables trial use of an effector without going to a musical instrument store by using the Internet.

A client in Unexamined Japanese Patent Publication No. H11-085148 receives a sound signal of a musical instrument from a soundboard 1*a*, which serves as sound device, and transmits it to an effector server 3. An effector group 4 is connected to the effector server 3. The effector server 3 reproduces the sound data that has been received from the client through the Internet 2, and modulates it in the effector group 4. The effector server 3 transmits the sound data after the modulation to the client. The client receives the sound data after the modulation and outputs a sound from a speaker connected to the soundboard 1*a*.

SUMMARY

However, if any trouble occurs in the effector server 3, the effector trial-use service system disclosed in Unexamined Japanese Patent Publication No. H11-085148 may fail to receive sound data from the effector server 3. For that reason, the effector trial-use service system may fail to output a sound from a speaker.

One exemplary embodiment of the invention aims to provide a sound processing method, and a sound processing system which can prevent output of sounds from being stopped.

A sound processing method in accordance with one exemplary of the invention performs the following processing. Sound device receives a first sound signal from a first sound processor. The sound device generates a second sound signal based on the first sound signal. The sound device transmits the second sound signal to a second sound processor. The second sound processor performs signal processing to the second sound signal to generate a third sound signal. The sound device receives the third sound signal from the second sound processor. The sound device checks a state of the second sound processor based on the signal received from the second sound processor, transmits the fourth sound signal based on the third sound signal to the first sound processor when determining that the state of the second sound processor is normal, and generates a fifth sound signal based on the first sound signal or the second sound signal to transmit the fifth sound signal to the first sound processor, when determining that the state of the second sound processor is abnormal.

The sound processing method in accordance with one exemplary embodiment of the invention can prevent output of sounds from being stopped.

DETAILED DESCRIPTION

Figure 1:
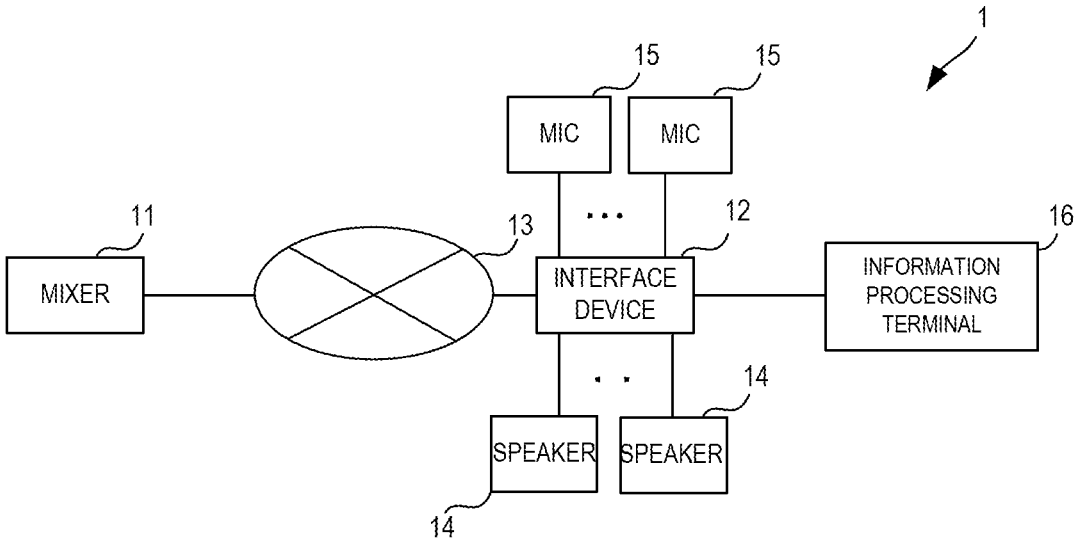
FIG. 1 is a block diagram showing a configuration of a sound processing system 1.

FIG. 1 is a block diagram showing a configuration of a sound processing system 1. The sound processing system 1 is provided with a mixer 11, an interface device 12, a network 13, a plurality of speakers 14, a plurality of microphones 15, and an information processing terminal 16. The mixer 11 is an example of a first sound processor of the present disclosure, and the information processing terminal 16 is an example of a second sound processor of the present disclosure. The interface device 12 is an example of sound device of the present disclosure.

The mixer 11 and the interface device 12 are connected to each other through a network cable. The interface device 12 is connected to the plurality of speakers 14 and the plurality of microphones 15 through audio cables. Further, the interface device 12 is connected to the information processing terminal 16 through a USB (Universal Serial Bus) cable.

However, in the present disclosure, the connection between these devices is not limited to the above-mentioned example. For instance, the mixer 11 and the interface device 12 may be connected to each other through an audio cable. Further, the interface device 12 and the information processing terminal 16 may be connected to each other through a network or may be connected through an audio cable.

Figure 2:
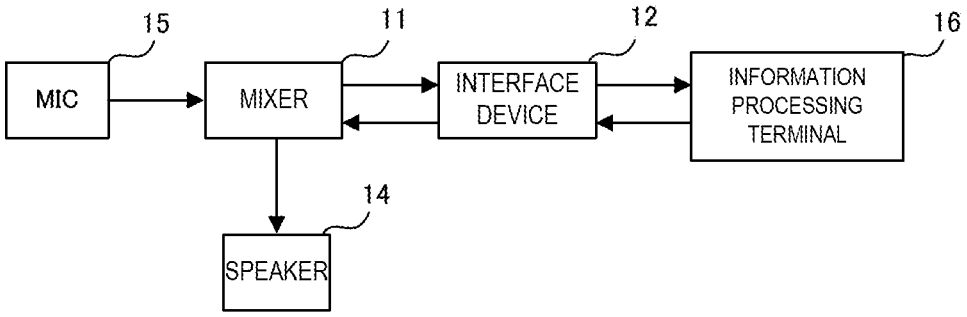
FIG. 2 is a block diagram showing a configuration of a mixer 11.

FIG. 2 is a block diagram conceptually showing a flow of a sound signal. As shown in FIG. 2, the mixer 11 receives a sound signal from each of the plurality of microphones 15 (in the figure, shown as the microphone 15). For explanation, FIG. 2 is illustrated such that the mixer 11 receive the sound signal from the microphone 15 directly, but in practice, the mixer 11 receives the sound signal from the microphone 15 through the interface device 12.

The mixer 11 performs signal processing, such as effect processing or mixing processing, to the sound signals received from the plurality of microphones 15. The mixer 11 transmits the sound signals, which are subjected to the signal processing, to each of the plurality of speakers 14 (in FIG. 2, shown as the speaker 14). For explanation, FIG. 2 is illustrated such that the mixer 11 transmits the sound signal to the speaker 14 directly, but in practice, the mixer 11 transmits the sound signal to the speaker 14 through the interface device 12.

The mixer 11 performs plug-in effect processing to sound signals (input signal) received from the plurality of microphones 15 or sound signals (output signal) to be outputted to the plurality of speakers 14 as an example of the signal processing. The plug-in effect is performed such that an insertion point is provided with respect to one signal-processing block among a plurality of signal-processing blocks and a signal-processing processor of the other device is used to perform effect processing at the insertion point.

The mixer 11 transmits a sound signal, which is located on an input side of the insertion point, to the interface device 12. The interface device 12 transmits the sound signal, which has been received from the mixer 11, to the information processing terminal 16. The information processing terminal 16 performs predetermined effect processing to the sound signal received from the interface device 12, and transmits it to the interface device 12. The interface device 12 transmits the sound signal, which is subjected to the effect processing, to the mixer 11. The mixer 11 receives the sound signal from the interface device 12. The mixer 11 outputs the received sound signal to an output side of the insertion point. Note that, the present exemplary embodiment shows the speaker 14 and the microphone 15 as an example of sound equipment connected to the interface device 12, but in practice, virous kinds of sound equipment are connected to the interface device 12.

Figure 3:
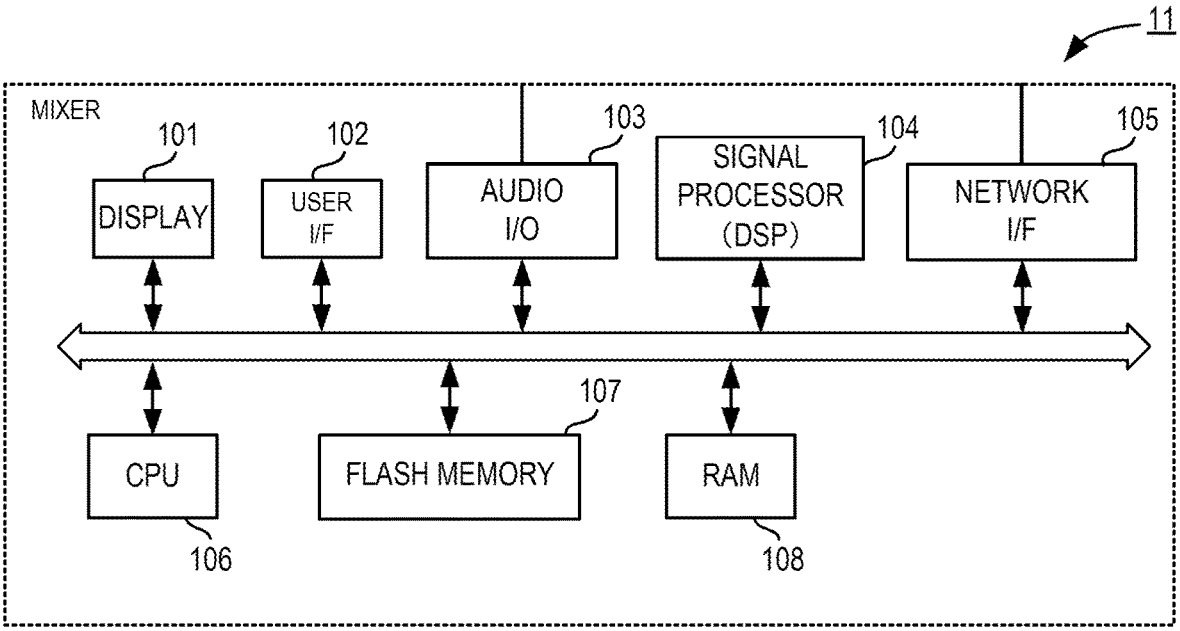
FIG. 3 is a block diagram showing a configuration of an interface device 12.

FIG. 3 is a block diagram showing a configuration of the mixer 11. The mixer 11 is provided with a display 101, a user I/F 102, an audio I/O (Input/Output) 103, a signal processor (DSP) 104, a network I/F 105, a CPU 106, a flash memory 107, and a RAM 108.

The CPU 106 is a controller that controls an operation of the mixer 11. The CPU 106 reads out a predetermined program stored in the flash memory 107, which serves as a storage medium, to the RAM 108 and executes it to perform various kinds of operations.

Note that, the program read by the CPU 106 is not required to be stored in the flash memory 107 of the mixer 11. For instance, the program may be stored in a storage medium of an external device such as a server. In this case, the CPU 106 may read out the program to the RAM 108 from the server and execute it, as necessary.

The signal processor 104 is constituted by a DSP for performing various kinds of signal processing. The signal processor 104 performs signal processing, such as effect processing and mixing processing, to the sound signal inputted from sound equipment such as the microphone 15 through the audio I/O 103 or the network I/F 105. The signal processor 104 outputs an audio signal, which is subjected to the signal processing, to sound equipment such as the speaker 14 through the audio I/O 103 or the network I/F 105.

Figure 4:
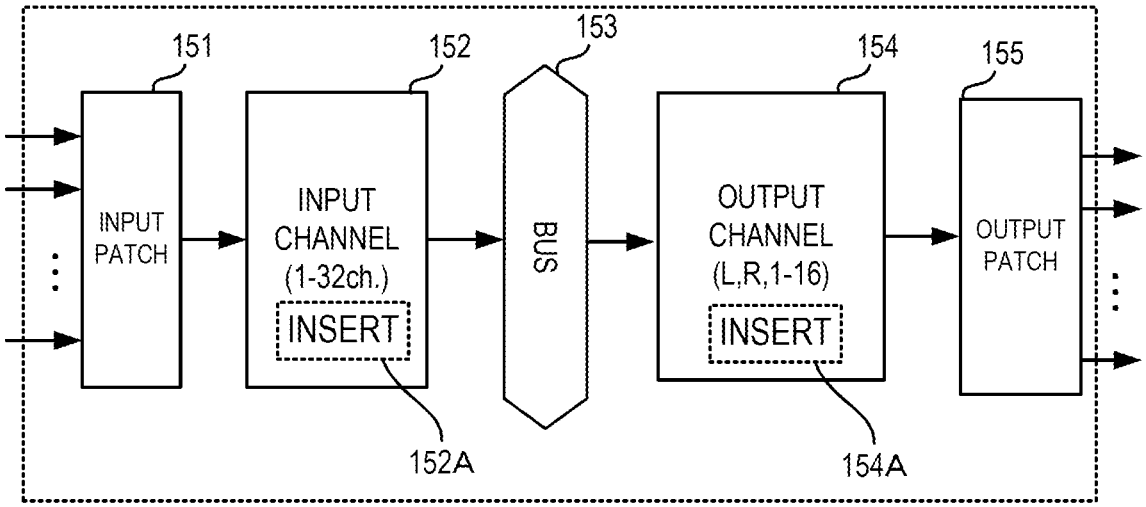
FIG. 4 is a functional block diagram showing a flow of sound signal processing in the mixer 11.

FIG. 4 is a functional block diagram showing a flow of sound signal processing in the mixer 11. As shown in FIG. 4, the signal processing is performed functionally by an input patch 151, an input channel 152, a bus 153, an output channel 154, and an output patch 155.

In the input patch 151, the received sound signal is assigned to at least one of a plurality of channels (e.g., 32*ch*).

In each channel of the input channel 152, predetermined signal processing is performed to the inputted sound signal. Each channel of the input channel 152 sends out an audio signal, which is subjected to the signal processing, to the subsequent bus 153. The bus 153 has a plurality of buses, such as a stereo bus (L, R bus) and a MIX bus, for example.

The output channel 154 has a plurality of channels each corresponding to each of the plurality of buses included in the bus 153. In each channel of the output channel 154, various kinds of signal processing are performed to the inputted sound signal, like the input channel.

Each channel of the output channel 154 sends out an audio signal, which is subjected to the signal processing, to the output patch 155. In the output patch 155, each output channel is assigned to equipment to which the audio signal is to be sent out. Thus, the mixer 11 outputs the sound signal subjected to the signal processing to the speaker 14.

Further, the input channel 152 is provided with an insertion point (INSERT) 152A for inserting a plug-in effect. The output channel 154 is provided with an insertion point (INSERT) 154A for inserting a plug-in effect.

The sound signal inputted to INSERT 152A or INSERT 154A is transmitted to the information processing terminal 16 through the interface device 12. The sound signal, which is subjected to the plug-in effect processing in the information processing terminal 16, is returned back to INSERT 152A or INSERT 154A of the mixer 11 through the interface device 12.

Figure 5:
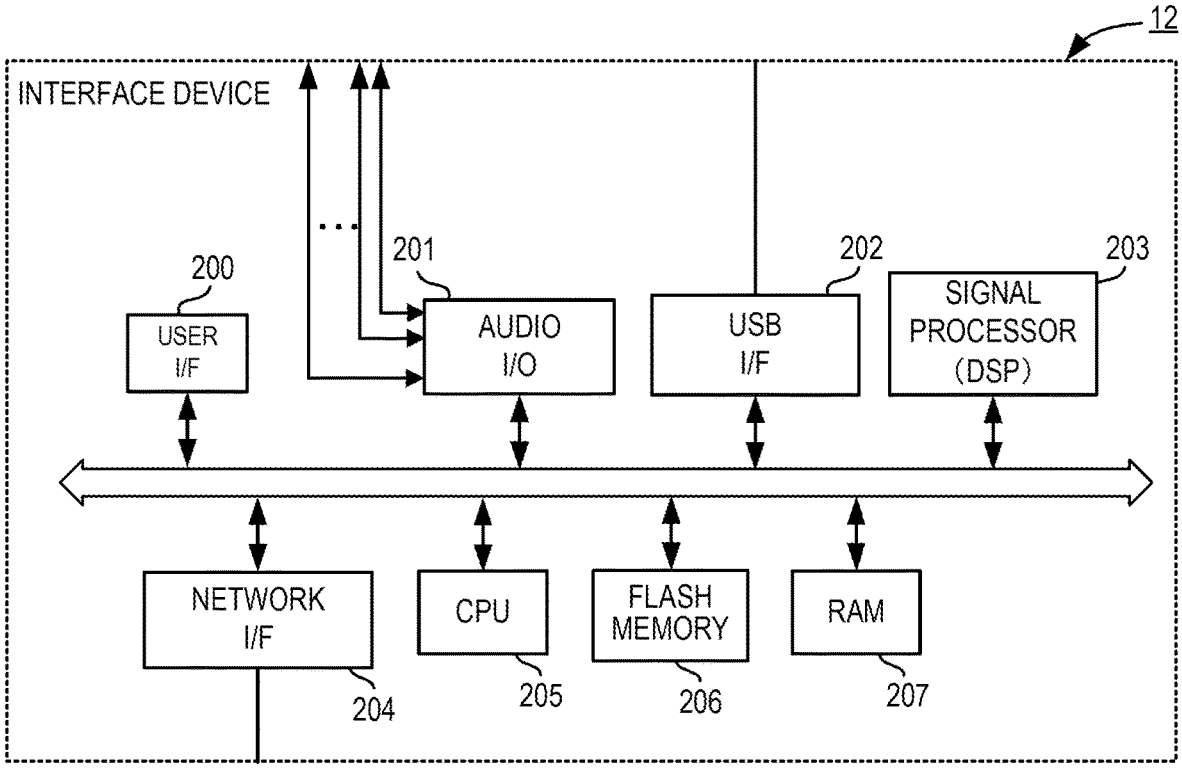
FIG. 5 is a block diagram showing a configuration of the interface device 12.

FIG. 5 is a block diagram showing a configuration of the interface device 12. The interface device 12 is provided with a user interface (I/F) 200, an audio I/O (Input/Output) 201, a USB I/F 202, a signal processor 203, a network interface (I/F) 204, a CPU 205, a flash memory 206, and a RAM 207.

The CPU 205 is a controller that controls an operation of the interface device 12. The CPU 205 reads out a predetermined program stored in the flash memory 206, which serves as a storage medium, to the RAM 207, and executes it to perform various kinds of operations.

Note that, the program read by the CPU 205 is also not required to be stored in the flash memory 206 of the interface device 12. For instance, the program may be stored in a storage medium of an external device such as a server. In this case, the CPU 205 may read out the program to the RAM 207 from the server and execute it, as necessary.

The signal processor 203, which is constituted by a DSP, performs various kinds of signal processing to the sound signal received from the audio I/O 201, the USB I/F 202, or the network I/F 204. For instance, packet data of a sound signal of a network standard, such as an AVB (Audio Video Bridging) or an AES (Audio Engineering Society) 76, received through the network I/F 204 is converted into packet data of a sound signal of a USB standard. Note that, the signal processing may be performed by the CPU 205.

Figure 6:
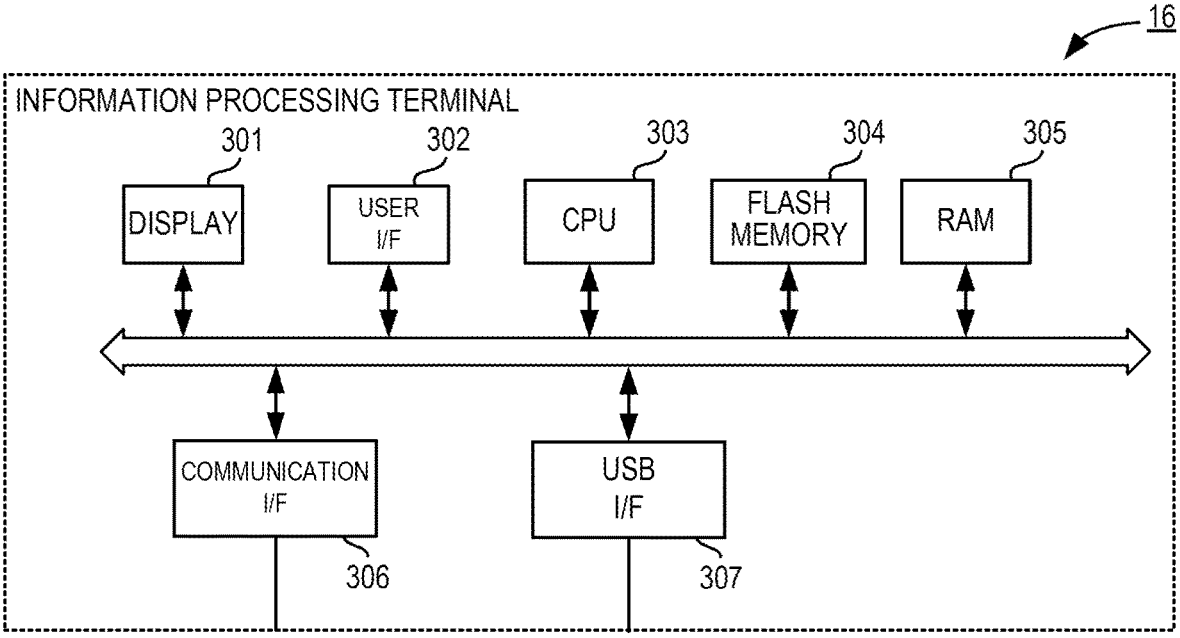
FIG. 6 is a block diagram showing a configuration of an information processing terminal 16.

FIG. 6 is a block diagram showing a configuration of the information processing terminal 16. The information processing terminals 16 is a general-purpose information processor such as a personal computer, a smart phone, or a tablet computer, for example.

The information processing terminal 16 is provided with a display 301, a user I/F 302, a CPU 303, a flash memory 304, a RAM 305, a communication I/F 306, and a USB I/F 307.

The CPU 303 reads out a program stored in the flash memory 304, which serves as a storage medium, to the RAM 305 to achieve a predetermined function. Note that, the program read by the CPU 303 is also not required to be stored in the flash memory 304 of the information processing terminal 16. For instance, the program may be stored in a storage medium of an external device such as a server. In this case, the CPU 303 may read out the program to the RAM 305 from the server and execute it, as necessary.

The information processing terminal 16 receives a sound signal from the interface device 12 through the USB I/F 307. The CPU 303 performs signal processing, such as plug-in effect processing, to the received sound signal. The CPU 303 transmits the sound signal, which is subjected to the effect processing, to the interface device 12 through the USB I/F 307.

Figure 7:
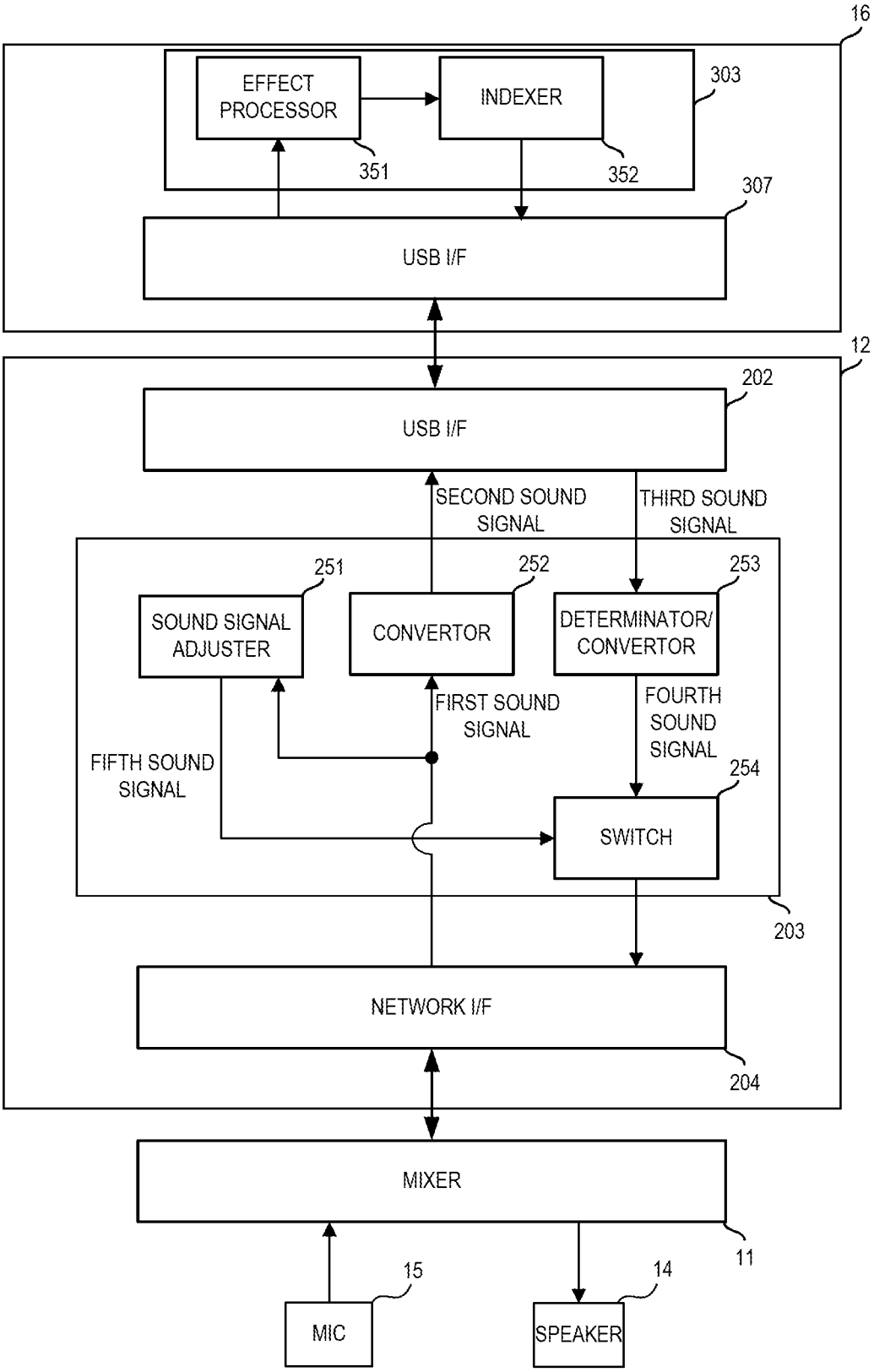
FIG. 7 is a functional block diagram showing a sound signal flow of plug-in effect processing in the mixer 11, the interface device 12, and the information processing terminal 16.
Figure 8:
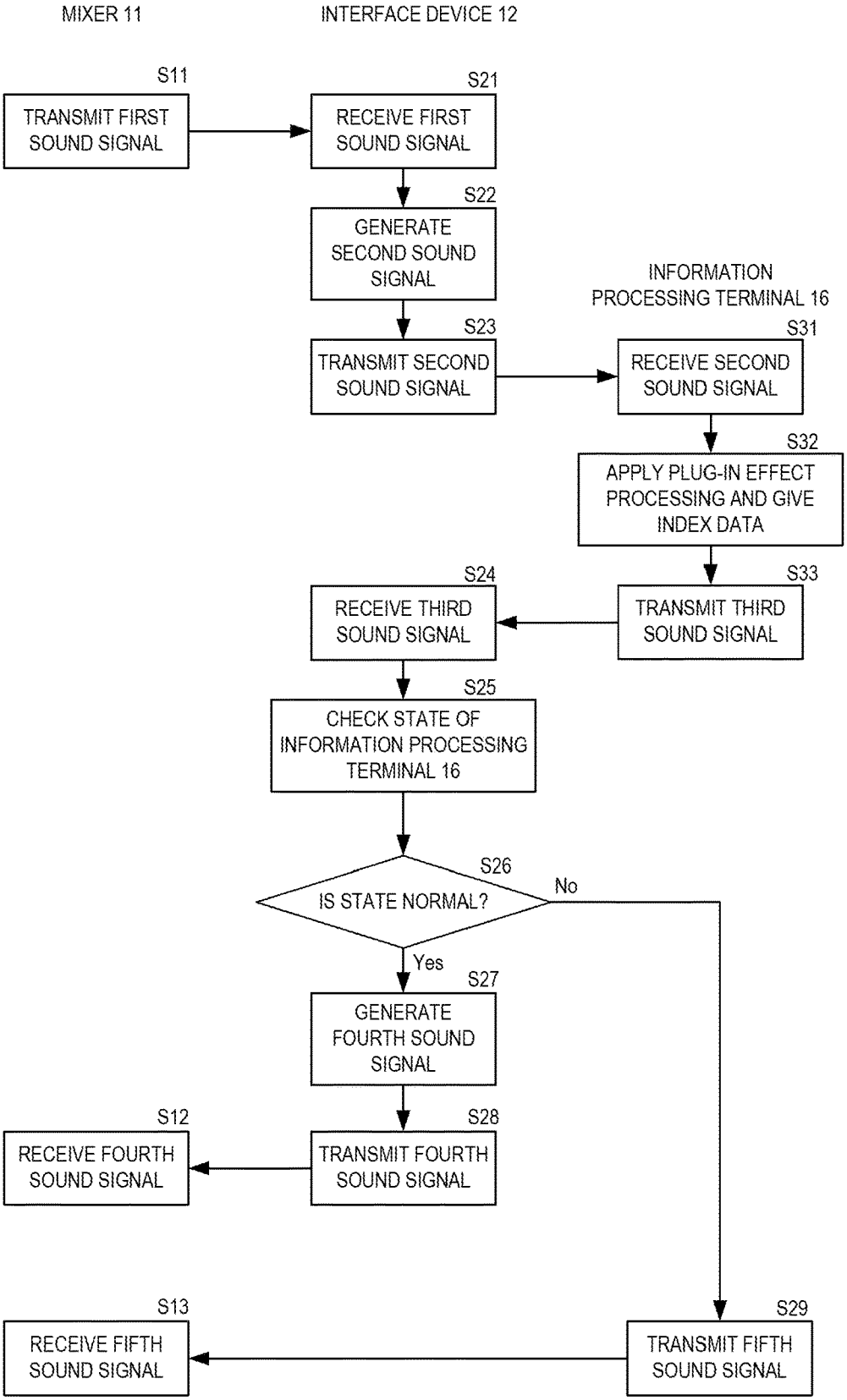
FIG. 8 is a flowchart showing operations of the mixer 11, the interface device 12, and the information processing terminal 16.

FIG. 7 is a functional block diagram showing a flow of a sound signal, which is subjected to plug-in effect processing, in the mixer 11, the interface device 12, and the information processing terminal 16. FIG. 8 is a flowchart showing an operation of each device.

First, the mixer 11 transmits a sound signal, which has been received from the microphone 15, to the interface device 12 as a first sound signal of a network standard (S11). The interface device 12 receives the first sound signal through a network (S21).

As shown in FIG. 7, the interface device 12 is functionally provided with a sound signal adjuster 251, a convertor 252, a determinator/convertor 253, and a switch 254. The configuration is achieved by the signal processor 203.

The convertor 252 generates a second sound signal of a USB standard from the first sound signal of a network standard (S22). The convertor 252 transmits the second sound signal of a USB standard to the information processing terminal 16 through the USB I/F 202 (S23).

The information processing terminal 16 receives the second sound signal (S31). The information processing terminal 16 is functionally provided with an effect processor 351 and an indexer 352. The configuration is achieved by the CPU 303. The effect processor 351, which is an example of the signal processor, performs signal processing, such as plug-in effect processing, to the second sound signal to generate a third sound signal, and the indexer 352 gives index data to the third sound signal (S32). Note that, the plug-in effect includes various kinds of effect processing such as a head amplifier, a noise gate, an equalizer, and a compressor. Further, the plug-in effect also includes mixing processing in which a plurality of sound signals are superimposed.

Figure 9:
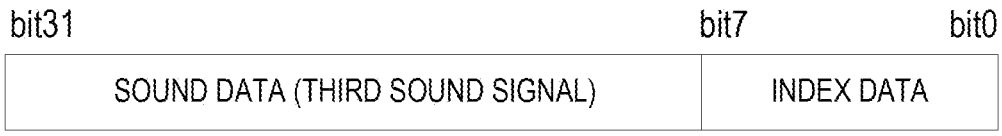
FIG. 9 is a view showing a structure of sound data of one sample.

FIG. 9 is a view showing a structure of sound data of one sample. Index data is embedded in lower bits of the sound data (third sound signal). For instance, in the example of FIG. 9, the index data, which is 8-bit data, is expressed by numerical values of 0 to 255 arranged in time series. The index data is increased by one for each sample. When being increased to 255, the bit data returns to 0. However, the number of bits is not limited to this example.

The information processing terminal 16 transmits the third sound signal to the interface device 12 (S33). Herein, index data is given in the third sound signal. The interface device 12 receives the third sound signal (S24). The determinator/convertor 253 checks a state of the information processing terminal 16 based on the index data given in the third sound signal (S25).

Since the index data is increased by one for each sample as mentioned above, the determinator/convertor 253 is provided with an index memory that includes a first memory area and a second memory area. The first memory area stores first index data given in the third sound signal being currently received. The second memory area stores second index data given in the third sound signal of one sample before. To determine the continuity of bit data, the determinator/convertor 253 compares the first index data given in the third sound signal being received currently, and the second index data given in the third sound signal of one sample before. If the bit data are continuous, the determinator/convertor 253 will determine that the state of the information processing terminal 16 is normal. If the bit data are discontinuous, the determinator/convertor 253 will determine that the state of the information processing terminal 16 is abnormal (not normal).

When determining that the state of the information processing terminal 16 is normal (Yes in S26), the determinator/convertor 253 converts the third sound signal into a fourth sound signal of a network standard (S27). The determinator/convertor 253 causes the switch 254 to output the fourth sound signal. The switch 254 transmits the fourth sound signal to the mixer 11 (S28). The mixer 11 receives the fourth sound signal (S29). In this case, the mixer 11 supplies the fourth sound signal to the speaker 14.

On the other hand, when determining that the state of the information processing terminal 16 is not normal (No in S26), the determinator/convertor 253 causes the switch 254 to output a fifth sound signal. The switch 254 transmits the fifth sound signal to the mixer 11 (S29). The mixer 11 receives the fifth sound signal (S13). In this case, the mixer 11 supplies the fifth sound signal to the speaker 14.

The fifth sound signal is generated by the sound signal adjuster 251 based on the first sound signal that is transmitted from the mixer 11. Therefore, when determining that the state of the information processing terminal 16 is not normal, the interface device 12 bypasses the first sound signal and returns it to the mixer 11.

By the sound signal adjuster 251, delay processing and level change processing are performed to the first sound signal to generate the fifth sound signal. The sound signal adjuster 251 generates the fifth sound signal every time when receiving the first sound signal, irrespective of the state of the information processing terminal 16. The delay processing and the level change processing, which are performed by the sound signal adjuster 251, correspond to a delay and a level change in the plug-in effect processing of the information processing terminal 16. Thus, even if the sound signal, which is to be returned to the mixer 11, is switched from the fourth sound signal to the fifth sound signal, a change in time and volume is reduced. However, the delay processing and the level change processing, which are performed by the sound signal adjuster 251, are not essential.

As mentioned above, in the sound processing system 1 of the present exemplary embodiment, the information processing terminal 16 gives index data. Based on the index data, the interface device 12 determines the continuity of the sound signal to determine whether the state of the information processing terminal 16 is normal or not. When determining that the state of the information processing terminal 16 is not normal, the interface device 12 returns the sound signal, which has been received from the mixer 11, to the mixer 11. Thus, even when some trouble occurs in plug-in effect processing temporarily, the sound signal is not interrupted. This makes it possible to prevent output of sounds from being stopped.

The description of the present embodiments is illustrative in all respects and is not to be construed restrictively. The scope of the present invention is indicated by the appended claims rather than by the above-mentioned embodiments. Furthermore, the scope of the present invention is intended to include all modifications within the meaning and range equivalent to the scope of the claims. The present invention is performable for the following various kinds of modifications, for example.

(1) The interface device 12 generates the fifth sound signal based on the first sound signal that has been received from the mixer 11, but not limited to this. The interface device 12 may generate the fifth sound signal based on the second sound signal.

(2) The interface device 12 determines whether or not the state of the information processing terminal 16 is normal based on the index data, but not limited to this. The interface device 12 may determine whether or not the state of the information processing terminal 16 is normal based on the third sound signal. For instance, when not receiving the third sound signal, the interface device 12 determines that the state of the information processing terminal 16 is not normal.

(3) After a predetermined time elapses from determination of an abnormal state of the information processing terminal 16, when determining that the state of the information processing terminal 16 returns to be normal, the interface device 12 may transmit the fourth sound signal, which is based on the third sound signal received from the information processing terminal 16, to the mixer 11. Thus, when the state of the information processing terminal 16 returns to be normal, the interface device 12 automatically switches a sound signal, which is to be transmitted to the mixer 11, from the fifth sound signal to the fourth sound signal.

(4) The index data may be given by the interface device 12. In other words, the interface device 12 may give index data to the second sound signal and transmit it to the information processing terminal 16. If index data given to the second sound signal has the same bit value as index data given in the third sound signal, the interface device 12 may determine that the state of the information processing terminal 16 is normal. In this case, the interface device 12 may hold current index data and compare the held index data with index data given in the received third sound signal. In this case, the interface device 12 is not required to hold index data of one sample before.

(5) In the example of FIG. 9, the information processing terminal 16 gives index data in lower bits of sound data, but not limited to this. The information processing terminal 16 may transmit index data to the interface device 12 as different data from the sound signal data.

(6) The connection between the information processing terminal 16 and the interface device 12 is not limited to this example, i.e., not performed through a USB. For instance, the information processing terminal 16 and the interface device 12 may be connected through wireless communication. For instance, when the connection is performed by using the Wi-Fi (registered trademark) standard, the interface device 12 may further determine whether the state of the information processing terminal 16 is normal or not based on a time stamp given to packet data. Further, the sound signal adjuster 251 may perform delay processing, further considering delay time caused by wireless communication.

However, the time stamp given to packet data corresponds to a state of communication with the information processing terminal 16. Accordingly, if the determination is performed based on the time stamp, it will be determined whether the state of communication with the information processing terminal 16 is normal or not. On the other hand, the interface device 12 of the present exemplary embodiment performs the determination based on the index data given to the sound signal. Thus, the interface device 12 can check a state of plug-in effect processing in the information processing terminal 16. Therefore, even when the state of communication with the information processing terminal 16 is normal, if the sound signal is abnormal, the interface device 12 will return the sound signal, which has been received from the mixer 11, to the mixer 11. Accordingly, even when some trouble occurs in plug-in effect processing temporarily, sound signals are not interrupted, thereby making it possible to prevent an abnormality from occurring in sounds to be supplied to the speaker 14.

(7) The delay time and the level change amount in the sound signal adjuster 251 may be constant or variable. The delay time or the level change amount may be specified by a user through the user I/F 200 of the interface device 12. The interface device 12 may compare the second sound signal and the third sound signal to obtain delay time or a level difference. The interface device 12 may display the obtained delay time or level difference on a display (not shown). In this case, by referring the displayed delay time or level difference, a user can specify delay time or a level change amount. Further, the interface device 12 may adjust the delay time or the level change amount automatically based on the obtained delay time or level difference. Note that, an amount of delay time caused by each effect is previously determined in plug-in effect processing. Therefore, the interface device 12 may obtain information on delay time caused by plug-in effect processing in the information processing terminal 16 and adjust delay time automatically based on the obtained information.

(8) Through the user I/F 200 of the interface device 12, a user may switch a sound signal, which is to be transmitted to the mixer 11, manually from the fourth sound signal to the fifth sound signal. Further, by a user, only a specific channel may be switched manually from the fourth sound signal to the fifth sound signal or all the channels may be switched from the fourth sound signal to the fifth sound signal. In this case, the user I/F 200 is provided with a switch for switching each channel, a switch for switching all the channels, or the like.

(9) In the above-mentioned exemplary embodiment, by comparing index data of the third sound signal being currently received and index data of the third sound signal of one sample before, the interface device 12 can determine whether the state of the information processing terminal 16 is normal or not in a period corresponding to one sample. In other words, the interface device 12 can check a state of plug-in effect processing, which is performed in the information processing terminal 16, in real time. However, in the case where an abnormality occurs continuously in index data of a plurality of samples, the interface device 12 may determine that a state of the information processing terminal 16 is not normal. For instance, when an abnormality occurs continuously in index data of 100 samples, the interface device 12 may determine that a state of the information processing terminal 16 is not normal.

(10) Through the user I/F 200 of the interface device 12A, a user may specify the number of samples required for the interface device 12 to determine that a state of the information processing terminal 16 is not normal. Further, in (3) mentioned above, a user may specify the number of samples required for automatically switching a sound signal, which is to be transmitted to the mixer 11, from the fifth sound signal to the fourth sound signal. The smaller the specified number of samples is, the shorter the time required for switching a sound signal at the time when an abnormality occurs or the abnormality is restored is, whereas the larger the specified number of samples is, the longer the time required for switching is. When the time required for switching is made shorter, sounds are less likely to be interrupted or unusual sounds are less likely to be supplied to the speaker 14. However, if the sound signal is switched frequently, a user may feel uncomfortable. Since the interface device 12 receives a length of the time required for switching through user's specification, a user can set a switching timing as intended, so that such uncomfortable feeling can be reduced.

(11) When changing the plug-in effect to another plug-in effect, the information processing terminal 16 may send an event notification to the interface device 12. When receiving the event notification, even if the state of the information processing terminal 16 is determined to be abnormal subsequently, the interface device 12 transmits the fourth sound signal to the mixer 11. Thus, the interface device 12 is avoided from misunderstanding that the change of plug-in effect processing is determined to be an abnormality.

(12) The number of bits is not limited to 8 bits. For instance, the number of bits may be 10 bits. In this case, the index data is expressed by numerical values of 0 to 1023. Further, the index data may be time information. For instance, the index data may be time information at the time when the information processing terminal 16 is started. In this case, the interface device 12 determines the continuity of bit data at predetermined intervals (e.g., every one second) based on the time information.

(13) The above-mentioned exemplary embodiment shows the interface device 12 as an example of sound device of the present disclosure. The sound device of the present disclosure may be a mixer, an information processor, a sound signal processor, an amplifier, or the like.

What is claimed is:

1. A sound processing method of a sound processing system that is provided with sound device, a first sound processor, and a second sound processor, wherein:

the sound device receives a first sound signal from the first sound processor, generates a second sound signal based on the first sound signal, and transmits the second sound signal to the second sound processor;

the second sound processor performs signal processing to the second sound signal to generate a third sound signal; and the sound device receives the third sound signal from the second sound processor, checks a state of the second sound processor based on a signal received from the second sound processor, transmits a fourth sound signal based on the third sound signal to the first sound processor when determining that the state of the second sound processor is normal, and generates a fifth sound signal based on the first sound signal or the second sound signal to transmit the fifth sound signal to the first sound processor when determining that the state of the second sound processor is abnormal.

2. The sound processing method according to claim 1, wherein the sound device adds a delay or a level change to the first sound signal or the second sound signal to generate the fifth sound signal, the delay or the level change corresponding to the signal processing performed by the second sound processor.

3. The sound processing method according to claim 1, wherein the sound device checks the state of the second sound processor based on index data including time series information given to the second sound signal or the third sound signal.

4. The sound processing method according to claim 3, wherein the sound device comprises an index memory including a first memory area and a second memory area, the first memory area storing first index data that is given in the third sound signal being currently received, the second memory area storing second index data that is given in the third sound signal of one sample before, wherein the first index data of the first memory area and the second index data of the second memory area are compared to determine the state of the second sound processor.

5. The sound processing method according to claim 4, wherein the sound device checks the state of the second sound processor by determining whether the first index data and the second index data are related in time series as a result of the comparison.

6. The sound processing method according to claim 1, wherein when the signal processing is performed to cause time series discontinuity of the third sound signal, the second sound processor sends an event notification to the sound device before the signal processing is performed, and when receiving the event notification, the sound device transmits the fourth sound signal based on the third sound signal to the first sound processor, even when the state of the second sound processor is subsequently determined to be abnormal.

7. The sound processing method according to claim 1, wherein after a predetermined time elapses from determination of an abnormal state of the second sound processor, when determining that the state of the second sound processor is normal, the sound device transmits the fourth sound signal based on the third sound signal to the first sound processor.

8. The sound processing method according to claim 7, wherein a length of the predetermined time is specified from a user.

9. The sound processing method according to claim 1, wherein the first sound processor receives a sound signal from sound equipment, and transmits the first sound signal based on the sound signal that has been received from the sound equipment.

10. The sound processing method according to claim 1, wherein the first sound processor transmits a sound signal to sound equipment, the sound signal being based on the fourth sound signal or the fifth sound signal that has been received from the sound device.

11. A sound processing system comprising:

sound device;

a first sound processor; and a second sound processor, wherein:

the sound device receives a first sound signal from the first sound processor, generates a second sound signal based on the first sound signal, and transmits the second sound signal to the second sound processor;

the second sound processor performs signal processing to the second sound signal to generate a third sound signal; and the sound device receives the third sound signal from the second sound processor, checks a state of the second sound processor based on a signal received from the second sound processor, transmits a fourth sound signal based on the third sound signal to the first sound processor when determining that the state of the second sound processor is normal, and generates a fifth sound signal based on the first sound signal or the second sound signal to transmit the fifth sound signal to the first sound processor when determining that the state of the second sound processor is abnormal.

12. The sound processing system according to claim 11, wherein the sound device adds a delay or a level change to the first sound signal or the second sound signal to generate the fifth sound signal, the delay or the level change corresponding to the signal processing performed by the second sound processor.

13. The sound processing system according to claim 11, wherein the sound device checks the state of the second sound processor based on index data including time series information given to the second sound signal or the third sound signal.

14. The sound processing system according to claim 13, wherein the sound device comprises an index memory including a first memory area and a second memory area, the first memory area storing first index data that is given in the third sound signal being currently received, the second memory area storing second index data that is given in the third sound signal of one sample before, wherein the first index data of the first memory area and the second index data of the second memory area are compared to determine the state of the second sound processor.

15. The sound processing system according to claim 14, wherein the sound device checks the state of the second sound processor by determining whether the first index data and the second index data are related in time series as a result of the comparison.

16. The sound processing system according to claim 11, wherein when the signal processing is performed to cause time series discontinuity of the third sound signal, the second sound processor sends an event notification to the sound device before the signal processing is performed, and when receiving the event notification, the sound device transmits the fourth sound signal based on the third sound signal to the first sound processor, even when the state of the second sound processor is subsequently determined to be abnormal.

17. The sound processing system according to claim 11, wherein after a predetermined time elapses from determination of an abnormal state of the second sound processor, when determining that the state of the second sound processor is normal, the sound device transmits the fourth sound signal based on the third sound signal to the first sound processor.

18. The sound processing system according to claim 17, wherein a length of the predetermined time is specified from a user.

19. The sound processing system according to claim 11, wherein the first sound processor receives a sixth sound signal from sound equipment, and transmits the first sound signal based on the received sixth sound signal.

20. The sound processing system according to claim 11, wherein the first sound processor transmits a seventh sound signal to sound equipment, based on the fourth sound signal or the fifth sound signal that has been received from the sound device.

* * * * *